US008845224B2

(12) United States Patent
Hirahara

(10) Patent No.: US 8,845,224 B2
(45) Date of Patent: Sep. 30, 2014

(54) DESKTOP LOOSE-LEAF BASE, AND BINDER

(75) Inventor: Yutaka Hirahara, Osaka (JP)

(73) Assignee: Calendar Kokoku Co., Ltd., Osaka (JP)

( * ) Notice: Subject to any disclaimer, the term of this patent is extended or adjusted under 35 U.S.C. 154(b) by 61 days.

(21) Appl. No.: 13/379,908

(22) PCT Filed: Aug. 7, 2010

(86) PCT No.: PCT/JP2010/063433
§ 371 (c)(1),
(2), (4) Date: Dec. 21, 2011

(87) PCT Pub. No.: WO2011/019007
PCT Pub. Date: Feb. 17, 2011

(65) Prior Publication Data

US 2012/0119481 A1 May 17, 2012

(30) Foreign Application Priority Data

Aug. 11, 2009 (JP) ..... 2009-202051

(51) Int. Cl.

| | |
|---|---|
| ***B42F 13/00*** | (2006.01) |
| ***B42F 3/00*** | (2006.01) |
| ***B42F 13/40*** | (2006.01) |
| ***B42F 3/02*** | (2006.01) |
| ***B42F 13/02*** | (2006.01) |
| ***B42F 3/04*** | (2006.01) |
| ***B42F 13/20*** | (2006.01) |
| ***B42F 13/30*** | (2006.01) |
| ***B42F 13/12*** | (2006.01) |
| ***B43M 99/00*** | (2010.01) |
| ***B42F 13/26*** | (2006.01) |
| ***B43K 23/00*** | (2006.01) |
| ***B42D 5/04*** | (2006.01) |

(52) U.S. Cl.

CPC ..... *B42D 5/041* (2013.01); *B43M 99/008* (2013.01); *B42F 13/26* (2013.01); *B42F 13/406* (2013.01); *B43K 23/001* (2013.01); *B42D 5/045* (2013.01)

USPC ..... 402/26; 402/5; 402/7; 402/19; 402/31; 402/36; 402/46; 402/70; 402/73

(58) Field of Classification Search

USPC ..... 402/5, 7, 19, 26, 31, 36, 46, 70, 73
See application file for complete search history.

(56) References Cited

U.S. PATENT DOCUMENTS

| | | | |
|---|---|---|---|
| 1,837,424 | A | 12/1931 | Gannon |
| 4,214,839 | A | 7/1980 | Sheehan et al. |

(Continued)

FOREIGN PATENT DOCUMENTS

| | | |
|---|---|---|
| CN | 215662 | 1/1994 |
| CN | 101386241 | 3/2009 |

(Continued)

OTHER PUBLICATIONS

Office Action, Chinese Statement Intellectual Property Office (SIPO), Mar. 5, 2012.

(Continued)

*Primary Examiner* — Shelley Self
*Assistant Examiner* — Justin V Lewis
(74) *Attorney, Agent, or Firm* — Antonelli, Terry, Stout & Kraus, LLP.

(57) ABSTRACT

A desk leaf base has a base formed of a trapezoidal tubular body in a trapezoidal shape in a side view, closed from a bottom surface to a certain height in both sides, and opened in an upper portion therefrom. An inclined front wall of the tubular body is removed from one side to the other side, in a range from the height to a higher height lower than a top surface. A binder mounted along an elongated top surface of the base has an elongated body and rings. The elongated body is mounted along the top surface of the base with an approximately same width as the top surface. The rings are mounted on the body and capable of opening and closing. Each ring includes linear portions that protrude from the body inclining upward on front and back sides when closing.

4 Claims, 4 Drawing Sheets

(56) References Cited

U.S. PATENT DOCUMENTS

| | | | | |
|---|---|---|---|---|
| 5,379,979 | A | 1/1995 | Due | |
| 2007/0086836 | A1 | 4/2007 | Cheng | |
| 2007/0134053 | A1 | 6/2007 | Haneda et al. | |
| 2007/0134054 | A1* | 6/2007 | Li | 402/36 |
| 2007/0274769 | A1 | 11/2007 | Shimada et al. | |
| 2008/0008519 | A1 | 1/2008 | To | |
| 2009/0053012 | A1 | 2/2009 | Tanaka et al. | |
| 2009/0067915 | A1 | 3/2009 | To | |

FOREIGN PATENT DOCUMENTS

| | | | |
|---|---|---|---|
| EP | 0537438 | | 4/1993 |
| JP | 33-1206 | Y1 | 2/1958 |
| JP | 57-20381 | Y2 | 4/1982 |
| JP | 08-244391 | | 9/1996 |
| JP | 2000-025379 | | 1/2000 |
| JP | 2002-205479 | | 7/2002 |
| JP | 2003-112492 | | 4/2003 |
| JP | 2004-255836 | | 9/2004 |
| JP | 2005-144714 | | 6/2005 |
| JP | 2006-200155 | | 8/2006 |
| JP | 2008-893 | | 1/2008 |
| JP | 2008-100390 | | 5/2008 |
| JP | 2008-288146 | | 5/2010 |
| TW | M340177 | U | 9/2008 |
| WO | WO2010053211 | | 5/2010 |

OTHER PUBLICATIONS

Second Office Action issued on Dec. 25, 2012 from Chinese State Intellectual Property Office regarding counterpart PCT—China application corresponding to the present PCT-US application.

Second Office Action issued on Feb. 11, 2013 from New Zealand Intellectual Property Office regarding counterpart PCT—New Zealand application corresponding to the present PCT-US application.

Search Report and Written Opinion issued on Jun. 10, 2013 from Intellectual Property Office of Singapore regarding counterpart PCT—Singapore application corresponding to the present PCT-US application.

First Office action issued on Jun. 11, 2013 from Eurasian Patent Office regarding counterpart PCT—Eurasia application corresponding to the present PCT-US application.

1st Japanese Office Action, JP 2008-288146, Jan. 20, 2009, Heisel21.

4th Japanese Office Action (Part 2), JP 2008-288146, Jun. 30, 2009, Heisel 21.

2nd Japanese Office Action (Final), JP 2009-202051 (Priority Application), Mar. 1, 2010.

1st Japanese Office Action, JP 2009-202051 (Priority Application), Nov. 4, 2009.

3rd Japanese Office Action, JP 2009-202051 (Priority Application), May 25, 2010.

3d Japanese Office Action (Examiner's Final Decision), JP 2009-202051 (Priority Application), May 25, 2010.

Written Request for Patent (Yutaka Hiahara), ID No. 506229028 (Calenar Kokoku Co., Ltd.) Nov. 20, 2008.

JPT_005305768-20100406-00 (Japan Trademark Registration Publication) (Registration No. 5305768), filed by Calendar Kokoku., Ltd, and laid open on Oct. 22, 2009.

JPT_005330432-20100720-00 (Japan Trademark Registration Publication) (Registration No. 5330432), filed by Calendar Kokoku Co., Ltd, and laid open on Feb. 18, 2010.

JPT_005360503-20101116-00 (Japan Trademark Registration Publication) (Registration No. T5360503), filed by Calendar Kokoku Co., Ltd, and laid open on Jul. 1, 2010.

JP4_2010026546-20100506-00 (Japan Trademark Laid-Open Publication) (Application No. T2010-28546), filed by Calendar Kokoku Co., Ltd, and laid open on May 6, 2010.

International Search Report for the present PCT-US application (English translation is attached by IB), Nov. 2, 2010.

1st Office Action for priority application JP2009-202051 of the present PCT-US application, Nov. 4, 2009.

2nd Office Action for priority application JP2009-202051 of the present PCT-US application, Mar. 1, 2010.

3rd Office Action (part 1) for priority application JP2009-202051 of the present PCT-US application, May 25, 2010.

3rd Office Action (part 2) for priority application JP2009-202051 of the present PCT-US application, May 25, 2010.

1st Office Action for priority application JP2008-288146 (Foreign Patent Document 6) of WO2010053211 (Foreign Patent Document 1), Jan. 20, 2009.

2nd Office Action for priority application JP2008-288146 (Foreign Patent Document 6) of WO2010053211 (Foreign Patent Document 1), Apr. 7, 2009.

3rd Office Action (after submission of Notice of Appeal) for priority application JP2008-288146 (Foreign Patent Document 6) of WO2010053211 (Foreign Patent Document 1), Oct. 2, 2009.

4th Office Action (Part 1) (after submission of Notice of Appeal) for priority application JP2008-288146 (Foreign Patent Document 6) of WO2010053211 (Foreign Patent Document 1), Dec. 10, 2009.

4th Office Action (Part 2) (after submission of Notice of Appeal) for priority application JP2008-288146 (Foreign Patent Document 6) of WO2010053211 (Foreign Patent Document1), Dec. 10, 2009.

English Translation of International Preliminary Report on Patentability Chapter I (IB373) for WO2010053211 (Foreign Patent Document 1), Dec. 8, 2009.

* cited by examiner

DESKTOP LOOSE-LEAF BASE, AND BINDER

TECHNICAL FIELD

The present invention relates to a desk calendar.

BACKGROUND ART

A conventional ring binding type of desk calendar is manufactured by collectively and mechanically binding calendar leaves and a three-dimensional triangular base paper supporting the same by a wire ring binding member such as a single loop type ring or a W-ring. In this connection, thirteen leaves for one year are integrally bound at a top portion into a book.

Accordingly, the desk calendar is structured such as to be sorted or integrally disposed after the end of year. In other words, a new product having better function and use than the conventional product and manufacturing means for the same are demanded.

PRIOR ART DOCUMENTS

Patent Documents

Patent Document 1: Japanese National Publication of Translated Version No. 6-507582

Patent Document 2: Japanese Unexamined Patent Publication No. 2008-893

Patent Document 3: Japanese Unexamined Patent Publication No. 2008-100390

DISCLOSURE OF THE INVENTION

Problems to be Solved by the Invention

The aforementioned conventional ring desk calendar has following problems.

(1) Although it is natural that month covers of the desk calendar are thrown out every year, it is wasteful that a binding device thereof and a paperboard of the triangular base supporting the whole are also disposed. This has an adverse effect on the environment.

(2) Even if a provision of the conventional desk calendar is free or for value, a cost burden such as a working cost, a distribution cost and the like is added every year in addition to a material cost of the binding tool and the paperboard to be disposed.

(3) The manufacture of the conventional calendar is at its peak in about August usually every year, whereas, in the case where a national holiday is changed, a print is changed or a book binding error occurs, the leaves can not be replaced, and therefore completed articles are to be disposed.

(4) In the manufacture of the machine binding calendar, a unit cost for binding a small number of books is high, it is hard to diversify the articles, and it is hard to bind leaf groups differentiating the same based on customer needs for use of the calendar as a useful advertizing material.

(5) Upon searching prior art documents for the solution to the aforementioned problem, binding means of a paper ring in Japanese Unexamined Patent Publication No. 2008-893 is partly useful, whereas, since the means is disposed without allowing the leaves to be replaced, the means does not provide a solution. Further, there is a problem in employing the conventional file binder for the replacement of the leaves. The reason is as follows. Since a binder called "device for supporting binder" in Japanese National Publication of Translated Version No. 6-507582 has conventional truely circular rings having no hanging portion, a leaf group cannot be suspended, hole potions of the leaves are bent so as to generate a trace, and turned-over leaves are not stably attached to an opposite wall surface, but remain jumped up.

(6) It is necessary to integrate writing materials scattering on a desk or a counter and the desk calendar.

(7) In the manufacture of a resin integral type of container based on a demand for a toughness of the base and a reduction in the manufacturing unit cost, since it is hard to take out a metal mold for a trapezoidal container from an injection molding machine, an advantageous manufacturing method for a container is required.

Solutions to the Problems

In order to solve the problem mentioned above, in a desk calendar with an opening and closing mechanism according to the present invention, a trapezoidal leaf base is manufactured. Further, rings in which two engagement loops having such a space width as to bind a plurality of month covers and advertisements so as to suspend are freely opened and closed are formed on the top portion of the trapezoid, and an opening and closing mechanism having the rings with suspension widths in which the rings are formed in such a shape as to extend out in a lateral direction from a back width of a body portion of the opening and closing mechanism so as to be inclined under a closed position is manufactured and installed so that the bound leaves are suspended vertically. In other words, the leaf base having the opening and closing mechanism in which the leaves naturally drop onto and are closely and stably fitted to the base wall is manufactured. Further, a toughness and a durability are secured by manufacturing the trapezoidal base member from metal or resin.

Further, cover plates that occlude openings on the right and left sides of a lower portion of a cavity in the leaf base of the desk calendar are provided so as to form a container. In this connection, since the lower portion of the trapezoid forms the container, and the right and left sides of the upper portion function as entrances for the articles, the openings are expanded by forming such a structure that an intermediate wall portion is removed from one of the inclined side walls so as to be aligned with the container in height.

In a resin injection molding, a bottom and a main body of the container are independently formed and combined for manufacture.

Advantages Of The Invention

A file hanger of the desk calendar provided with the opening and closing mechanism having the binding device according to the present invention called, Hang Binder, is implemented in the configurations described above, and provides advantageous effects described below.

(1) In accordance with the present invention, the binding device of the conventional desk calendar and the triangular base paperboard supporting the whole are not manufactured, and the problem of the wasteful disposition and the adverse effect on the environment can be overcome.

(2) Whichever the provision of the calendar may be for value or free, the manufacturing cost of the conventional three parts integrated into one which are disposed every year can be reduced, and the desk calendar can be renewed only by supplying the leaves for every year.

(3) Even if the print is changed, the contents are changed or any mistake or error is found in the print or the collating of the book binding after the calendar is finished, the leaves can easily be replaced so that the disposition of the completed product can be avoided.

(4) Since the rings of the binding device can be opened and closed freely, a wide variety of inexpensive completed calendars can be provided even at a small amount. In other words, it is possible to manufacture a small amount of products upon request from a provider of the present articles or a regular user thereof.

(5) Since the calendar leaves and sheets can be replaced, it is possible to take up and store the data of the memorandum and the account book for years without disposing the base nor the used leaves at the year end.

(6) Once business enterprises or shops provide the leaf base to their customers, they can additionally provide the calendar leaves for the next year and the leaves with advertisement at the year end, and can maintain a long customer relationship.

(7) Once a user buys the desk calendar having the opening and closing mechanism, they can place desired photographs on the surfaces of new month covers for the next year by using a personal computer at the year end, and form an original desk calendar based on the base by printing out the month covers and providing the same with binding holes by use of a punch.

(8) Further, since the container is so structured that the openings on the right and left sides of the lower portion of the cavity in the three-dimensional trapezoidal calendar leaf base are occluded, the leaf base can be used as a storage device, a pen box or a pen case.

(9) In the manufacture of the resin container, the injection molded products of the main bodies without the bottoms can be stacked.

The objects, the features, the aspects and the advantages of the present invention will be more apparent by the following detailed description and the attached drawings.

EMBODIMENTS OF THE INVENTION

Hereinafter, preferable embodiments of the present invention will be given in detail with reference to the accompanying drawings.

(1) Whole Structure

Figure 1:
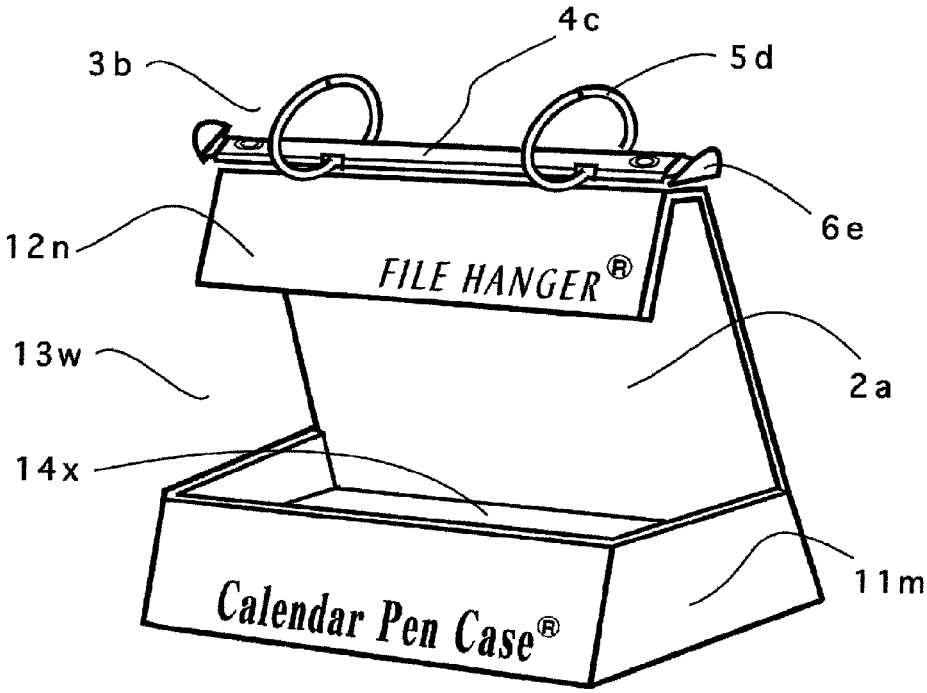
FIG. 1 is a front view showing a three-dimensional trapezoidal leaf base container according to an embodiment of the present invention.
Figure 2:
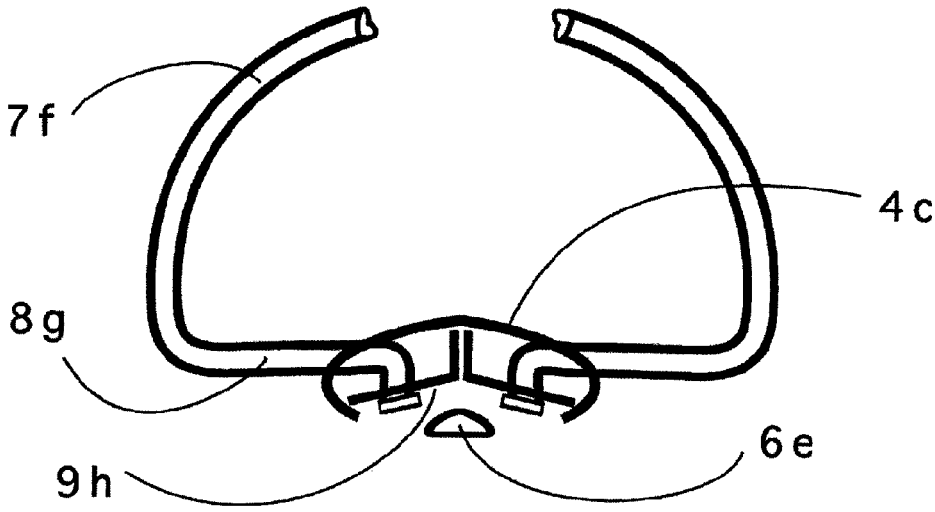
FIG. 2 is a view illustrating a ring of an opening and closing mechanism provided on the top surface of the leaf base at an opened position.
Figure 3:
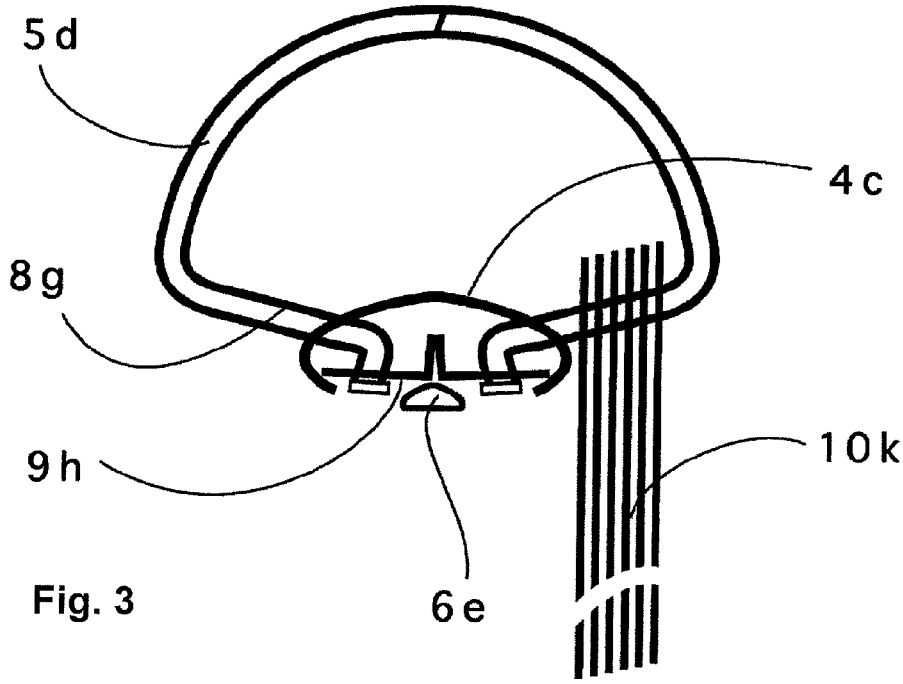
FIG. 3 is a view illustrating the ring of the opening and closing mechanism provided on the top surface of the leaf base at a closed position.
Figure 4:
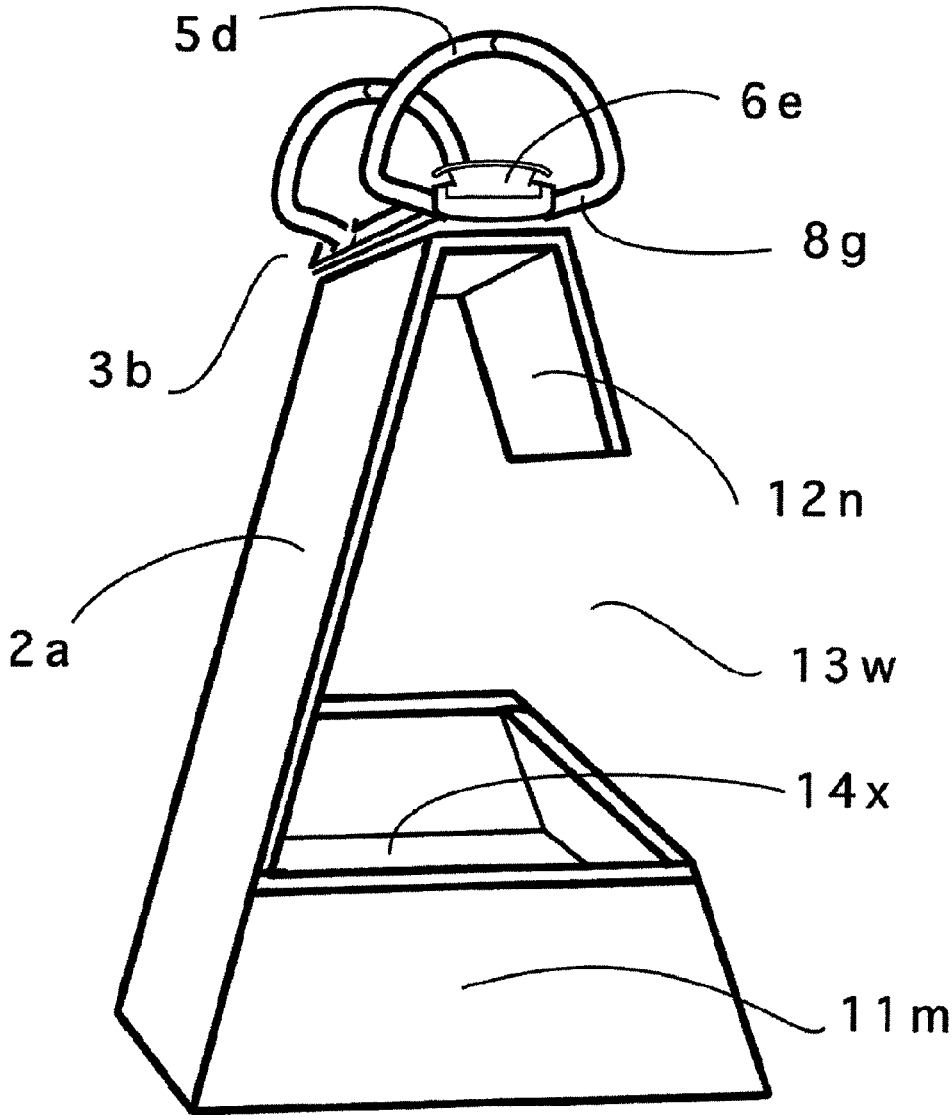
FIG. 4 is a side view of a Calendar Pen Case having the opening and closing mechanism according to the present invention.
Figure 5:
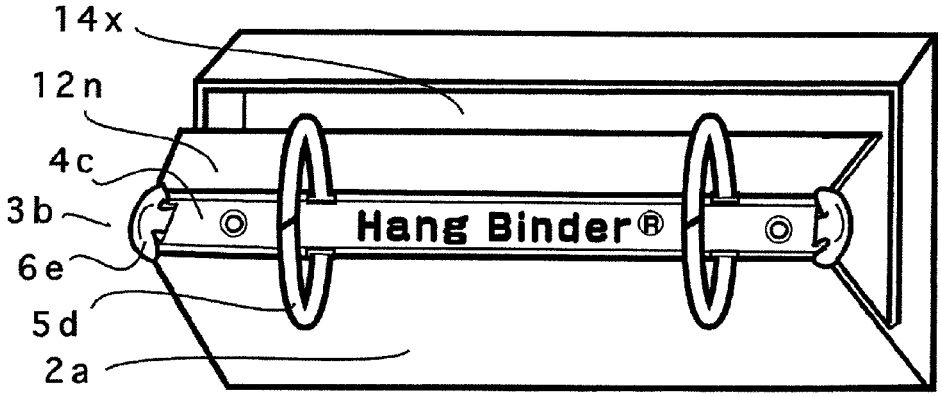
FIG. 5 is a top view of the Calendar Pen Case having the opening and closing mechanism according to the present invention.
Figure 6:
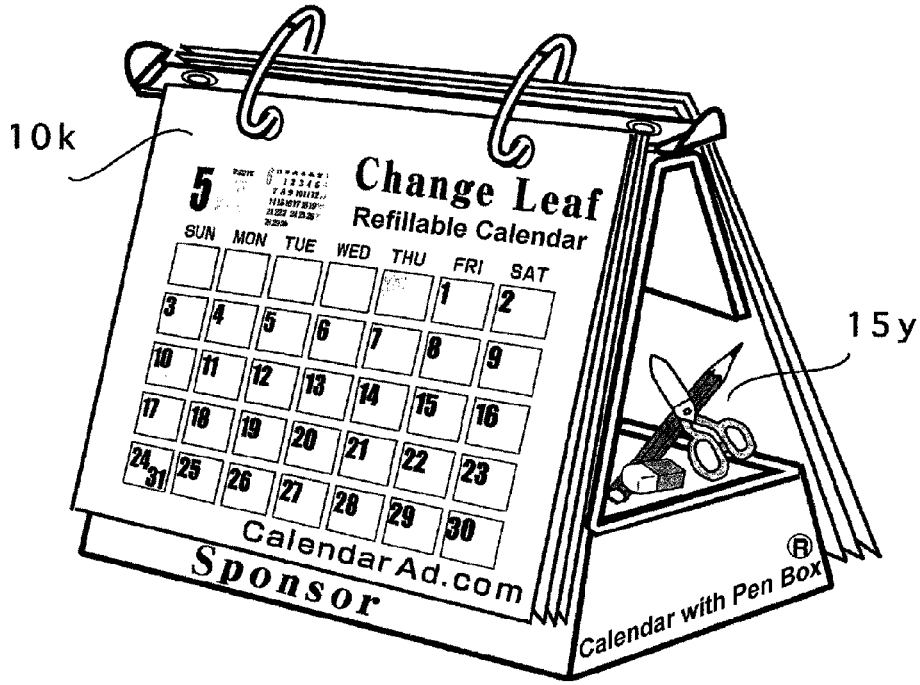
FIG. 6 illustrates a container type of desk calendar having a binder/calendar product having a pen box according to the present invention.

An opening and closing mechanism 3*b* at the top of side walls 2*a* of a trapezoidal leaf base constructing a container type of desk calendar having an opening and closing mechanism (FIG. 6) according to the present invention is comprised of two engagement rings 7*f* each having a suspension width space 8*g* which protrudes rightward and leftward with an inclination from a body cover 4*c* of a ring opening and closing mechanism (FIG. 2) attached to a position of a flat top surface of the base (FIG. 5). Specifically, the characteristics are in fan-shaped rings at their closed position from which calendar leaves having binding holes identical in number and interval with the rings are suspended (FIG. 3), and are also in a desk calendar base having a container provided with cover plates 11*m* in the leaf base (FIG. 4), wherein the two engagement rings are freely engaged and disengaged so as to form an opening and closing ring bodies as a binding device. In this connection, the characteristics are in a calendar leaf base container having an opening and closing mechanism manufactured as a Calendar Pen Case/calendar having pen box (FIG. 1) provided with a container formed by occluding the lower portions of the right and left openings of the cavity in the three-dimensional trapezoidal resin base with cover plates, and also provided with an entrance 13*w* for the writing materials formed by removing an intermediate portion of one of the inclined sidewalls 2*a* of the trapezoidal base having a cavity therein.

(2) Ring Opening and Closing Mechanism

The ring opening and closing mechanism is a writing material which is generally called a ring file binder, is used in a system pocketbook and a loose leaf and is supported by and covered with a sheet. The structure thereof is known.

A file binder is a ring mechanism for retaining paper group having holes at a plurality of positions, and is a mechanism for allowing the paper group to be inserted into gaps of the disconnected/opened rings and passing through the holes of the paper when the paper group is taken in and out, and for connecting the rings again at engagement portions thereof to bind the paper group so as to prevent the same from being dispersed.

The binder is structured such that two washers formed of engagement rings and jumping plates firmly fixed with each other are aligned and engaged and are wrapped and gripped by a lid made of a metal cover plate from the above. Further, all the rings including JIS standard products are formed in a complete round shape, a rectangular shape, an oval shape, a D-shape or a modified D-shape in their closed position, and are firmly fixed to the cover sheet for the purpose of overwrapping the file and be provided as a product. Accordingly, a necessity for extending the closed rings of the binder rightward and leftward from the back width of the body of the metal lid or a product having the same as the suspension device has not ever existed.

(3) Structure of Paper Suspending Device/Hang Binder/Opening and Closing Mechanism of Suspending Rings The opening and closing mechanism of the suspending rings according to the present invention is structured such that a ring opening and closing mechanism 3*b* mounted on and secured by rivets or the like to the flat top surface of the trapezoidal base formed of two side walls 2*a*, the base is placed on a desk and stands lofty, and the openings of the rings of the mechanism on the base are directed upward so as to be opened and closed rightward and leftward.

An inner portion of the ring opening and closing mechanism is constructed in such a manner that two elongated jumping plates 9*h* to which a plurality of engagement rings 7*f* are firmly fixed are engaged and arranged in parallel with each other, and a whole of the mechanism is retained and formed by a structure of being wrapped with the cover lid 4*c* made of a steel plate, which is the outer wall portion of the mechanism formed as a body, so as to prevent the jumping plates from breaking up. Describing further in detail, two engagement rings 7*f* which are formed as the ring shape in the closed position extend rightward and leftward from the back width of the steel cover plate while being inclined so as to protrude in an upward direction, and the inclined and extending spaces 8*g* are equal to the thickness of the paper group secured in space widths of a means for suspending the calendar papers to be mentioned below so as to closely attach them stably. Further, it is preferable that a leverage lever 6*e* is provided so as to allow the closed rings to be easily opened by one hand.

In this connection, since the rings 5*d* with a shape having the suspension positions 8*g* with the engagement rings 7*f* bonded is formed, there are shown the opened position (FIG. 2) and the closed position (FIG. 3) of the ring implemented by the ring opening and closing mechanism according to the present invention.

(4) Structure of Leaf Base and Leaf Base Container

The three-dimensional trapezoidal base part for manufacture supporting the paper suspending device/ring opening and closing mechanism according to the present invention is preferably made of metal or resin for the purpose of standing up to a load of the opening and closing mechanism at the top portion and the leaf group, and obtaining a certain lifetime of the product. Since the trapezoidal leaf base product is a tool for keeping a state in which the desk calendar leaves are suspended and erected on a small ? desk space, an area of the bottom is made as small as possible to such a level that the base main body does not fall down. Further, a numerical value of a width of a pedestal surface, i.e., the flat top surface of the base is made identical with a numerical value of the back width of the steel plate cover lid 4*c* in the body of the opening and closing mechanism installed thereon.

Further, in a means for forming the three-dimensional trapezoidal desk calendar as the tool which can be used as the storage container/pen box/pen case, the container is formed as a leaf base container by occluding the openings on the right and left sides of the lower portion of the base cavity with the cover plates 11*m*. Accordingly, since the lower portion of the trapezoid functions as the container and the openings which are opened on the right and left sides in the upper portion function as the entrances, a large opening which is convenient for the storage tool can be obtained by removing an intermediate portion of one of the inclined base walls from one to the other of the openings on the right and left sides while aligning the base wall with the lower container in height. It is possible to prevent the leaves from being curved due to a step by extending an eave plate 12*n* hanging over the opening downwardly as much as possible.

Since it is possible to package a plurality of trapezoidal main bodies in an overlapping manner by making their bottoms detachable in a container manufacturing method of combining two types of injection molded products, a cargo capacity in production and delivery works can be reduced.

(5) Junction of Ring Opening and Closing Mechanism and Trapezoidal Leaf Base Container The combination of the paper suspending tool/opening and closing mechanism mentioned above with the three-dimensional trapezoidal leaf base container enables manufacturing the leaf base container with the opening and closing mechanism (FIG. 1) having the ring capable of suspending the paper group. If the member for firmly fixing two bodies mentioned above is formed of cross slot screws in place of the rivets, it is preferable for a separated resource recovery and an environment countermeasure in the future.

In accordance with the present invention, a novel binder 3*b* having a suspension portion called Hang Binder, which is a trade mark registered with Japan Patent Office, is manufactured and is provided on the top surface of the leaf base container. Accordingly, the combined product called Calendar Pen Case, which is a trade mark registered for writing materials with Japan Patent Office, is provided as the desk leaf base.

(6) Manufacture of Calendar by Use of Leaf Base with Novel Binder

The leaf base with the opening and closing mechanism having the paper suspending rings mentioned above is called a file hanger, and the base provided with a container therein is called a calendar pen case. In this connection, since original month covers depending on the individual business enterprises, shops, corporations and the like, or nations or regions can be inserted to the leaf group of the new year calendar constructing the desk calendar, by using the leaf base product for a general purpose binding device, it is possible to manufacture the desk calendar as the product which meets the demand of the provision of a small amount of various kinds of inexpensive articles.

In the suspending engagement rings according to the present invention, since the portions 8*g* as the suspension portions, which extend rightward and leftward from the body with an inclination can be set large or small in width, it is possible to provide the rings having the suspension widths corresponding to a thickness of a block calendar or a month cover group to be inserted, and it is possible to provide a calendar including thirteen leaves, a fifteen months calendar for an end of the fiscal year and a block calendar including three hundreds and sixty five leaves.

(7) Replacement of Calendar Leaves and Advertisement Leaves

Since the present invention provides a desk calendar leaf base of a novel binder called File Hanger, by manufacturing Hang Binder as the opening and closing mechanism corresponding to the novel binder and attaching the same to the top surface of the trapezoidal base, it is possible to deliver the new year calendar and the leaflet together in one package.

In this connection, in addition to the various printed matters and sheets along with the calendar leaf with advertisement disclosed in Japanese registered design No. 1349842, it is possible to bind an order postcard for a new calendar leaf of the next year which is to be replaced at the year end.

Further, since the calendar with the pen box according to the present invention has a function of container, the writing tool and various small articles can be stored and can be covered by the leaf. In other words, the leaf base is a useful article on a permanent basis.

(8) New Business of Refilling Leaves

Mentioning the above in brief, the trapezoidal resin base is newly manufactured without using the paper triangular leaf base which is the conventional ring binding desk calendar. In this connection, the container is formed by providing walls on the right and left sides of a groove defined by the lower wall which is left in one of the sidewalls of the trapezoidal cavity type base after the intermediate portion thereof being removed, and also defined by the other one of the sidewalls. Further, a binder having fan shaped rings which can freely be opened and closed and have suspension spaces is newly manufactured as the leaf binding member without using any conventional O-type rings having no suspension widths. Accordingly, the provision of the opening and closing mechanism of the novel binder on the top surface of the novel base to manufacture the leaf base with the container allows the calendar paper group to be replaced, and also expands a function and use of the base.

Provision of the products according to the present invention is advantageous for an end user in use thereof as a desk calendar, various refilings, a pen case, an accessory box the like, and for business enterprises and shops in their long maintenance of customer relationship because the products not only allow the advertisement contents to be larger in volume than calendars with the enterprises' or shops' names displayed thereon which are distributed at the year end, but also require the leaves to be replaced. Further, fliers with calendar leaves enclosed together in one package or the calendar leaves according to the registered design with advertisements displayed thereon can be distributed without charge, and thereby, innovative products, services and business models which have not been provided conventionally can be provided, in accordance with catalogue sale of calendars with the catalogue calendars according to the registered trademark used as advertisement media, similarly to network and conventional catalogue sales.

The following can be included in one aspect of the present invention.

(Aspect 1)

A product of a desk calendar formed of three members including a plurality of calendar leaves with binding holes, a ring opening and closing mechanism corresponding to a binding tool thereof, and a three-dimensional trapezoidal base on which the opening and closing mechanism is mounted, wherein the ring opening and closing mechanism is manufactured as a device that functions to allows two engagement rings provided with space widths for suspending the paper group to be freely opened and closed, and is firmly fixed to a flat top surface of the trapezoidal base. In this connection, a manufacture of a leaf base including a trapezoidal metal or resin base, wherein a mechanism body of a binder is bonded on the top surface of the trapezoidal base, the mechanism body is an opening and closing mechanism having a plurality of rings having paper suspending portions, and the outline of the top surface is identical with the outline of the mechanism body in size.

In other words, a manufacture of a leaf base/File Hanger obtained by manufacturing the binder/Hang Binder having the paper suspension space portions of the opening and closing mechanism holding the fan-shaped rings in such a position as to extend with an inclination from cross lines between the top surface of the trapezoidal base and the side walls thereof, and mounting the same on the top surface of the base, and a manufacture of a desk calendar with an opening and closing mechanism, which provides calendar leaves with holes formed therein, wherein the calendar leaves are refill calendar papers provided with binding holes aligning with the rings in shape and number such that old month cover leaves can be replaced with new ones and renewed every year.

(Aspect 2)

A manufacture of a leaf base container wherein an entrance for articles is provided by removing an intermediate wall portion in one of inclined sidewalls of a three-dimensional trapezoidal cavity type base, and a pen case body with a ring file binder is provided in accordance with a method of forming a container in the form of a pen case by occluding the openings on the right and left sides of the lower portion of the cavity with cover plates, as a means for providing a container function in the leaf base with the ring opening and closing mechanism supporting the calendar leaves as described in the aspect 1. A manufacture of a desk calendar with a container type desk calendar/Calendar Pen Case/desk calendar with a pen box, wherein month covers and various sheets are bound by and suspended from the rings of the container type leaf base, and the writing materials are stored in the container.

(Aspect 3)

A bottom and a main body are independently formed by injection molding after manufacturing two kinds of metal molds for the bottom lid which constructs the base container and the trapezoidal main body with caulking holes, as a means for manufacturing the trapezoidal container of the leaf base formed of an opening and closing mechanism component and a resin base component by an injection molding machine. Accordingly, the main body corresponds to the member for forming the leaf base with the binder described in claim 1. Further, the leaf base container of the desk calendar with the pen box described in the aforementioned aspect 2 is manufactured by forming the container in accordance with the method of combining the aforementioned two resin molded products. In this connection, a manufacturing method of a calendar leaf base with a name displayed thereon which is provided after incusing and displaying a name of a providing sponsor business enterprise or shop on a resin wall surface of the leaf base component.

The present international patent application is based on Japanese Patent Application No. 2009-202051 which was filed on Aug. 11, 2009, and all the contents thereof is incorporated into the present application by reference.

The description mentioned above on the specific embodiments of the present invention is provided for the purpose of exemplifying. They are not exhaustive, and are not intended to limit the present invention to the described embodiments. It is obvious for those skilled in the art that a lot of modifications and changes can be derived with reference to the contents described above.

DESCRIPTION OF REFERENCE SIGNS

2*a* side wall of three-dimensional trapezoidal leaf base
3*b* opening and closing mechanism for paper suspending ring
4*c* cover lid of body steel plate of opening and closing mechanism
5*d* ring
6*e* lever
7*f* engagement ring
8*g* suspension width space
9*h* jumping plate
10*k* calendar leaves
11*m* cover plate
12*n* eave plate
13*w* entrance for articles
14*x* container
15*y* writing materials

The invention claimed is:

1. A desk leaf base, comprising:

a three-dimensional trapezoidal base member; and a binder, formed on a top portion of the three-dimensional trapezoidal base member, wherein the binder includes an elongated body, and a plurality of rings mounted on the body and capable of opening and closing;

wherein each of the plurality of rings includes linear portions that protrude from the body so as to extend inclining upward on both sides of the body when closed;

wherein the three-dimensional trapezoidal base member is a base formed of a trapezoidal tubular body, the tubular body being formed in a trapezoidal shape in a side view, closed from a bottom surface to a certain height in both sides, and opened in an upper portion therefrom, an inclined front wall of the tubular body being removed from one side to an other side, in a range from the certain height to a height higher than the certain height and lower than a top surface;

wherein the binder is mounted along an elongated top surface of the base member; and wherein the elongated body of the binder is mounted along the top surface of the base member with an approximately same width as the top surface.

2. The desk leaf base according to claim 1, wherein each of the plurality of rings is capable of opening and closing in its upper portion.

3. The desk leaf base according to claim 2, wherein each of the plurality of rings forms a fan-like shape when closed.

4. The desk leaf base according to claim 1, wherein each of the plurality of rings forms a fan-like shape when closed.

* * * * *